United States Patent [19]

Weihe, Jr.

[11] 4,098,196

[45] Jul. 4, 1978

[54] PORTABLE SKI TOW HOIST

[76] Inventor: Clyde R. Weihe, Jr., 17 Lindbergh Ave., Needham, Mass. 02192

[21] Appl. No.: 790,760

[22] Filed: Apr. 25, 1977

Related U.S. Application Data

[63] Continuation-in-part of Ser. No. 661,536, Feb. 26, 1976, abandoned.

[51] Int. Cl.[2] ..... B61B 12/10

[52] U.S. Cl. ..... 104/173 ST; 104/230; 104/233; 254/138

[58] Field of Search ..... 104/93, 115, 116, 173 R, 104/173 ST, 229, 230, 233, 236; 254/138, 175.3; 74/190, 192, 193, 196

[56] References Cited

U.S. PATENT DOCUMENTS

| | | | |
|---|---|---|---|
| 1,928,117 | 9/1933 | Stewart | 254/138 |
| 2,672,306 | 3/1954 | Doolittle et al. | 104/173 R |
| 3,166,021 | 1/1965 | Schippers | 104/173 ST |
| 3,338,180 | 8/1967 | Stecker | 104/173 R |
| 3,368,498 | 2/1968 | Doveri | 104/173 ST |
| 3,429,279 | 2/1969 | Pomagalski | 104/173 R |
| 3,773,167 | 11/1973 | McGinnis | 198/835 |
| 3,854,419 | 12/1974 | Cocroft | 104/93 |

FOREIGN PATENT DOCUMENTS

| | | | |
|---|---|---|---|
| 973,155 | 10/1972 | Canada | 254/138 |
| 1,351,766 | 12/1964 | France | 104/173 ST |
| 324,026 | 8/1959 | Switzerland | 254/175.3 |

*Primary Examiner*—Albert J. Makay
*Assistant Examiner*—Carl Rowold
*Attorney, Agent, or Firm*—Richard L. Stevens

[57] ABSTRACT

A rope tow for use on a ski slope. Rollers are rotatably mounted one above the other on a fixed frame; the bearing surfaces are in frictional engagement. One of the bearing surfaces has a plurality of ridges. A knotted endless rope is passed through the engaged surfaces. The ridges clamp the rope as it passes therethrough to prevent slippage.

2 Claims, 3 Drawing Figures

PORTABLE SKI TOW HOIST

CROSS REFERENCE TO RELATED APPLICATIONS

This application is a continuation-in-part of application Ser. No. 661,536, filed Feb. 26, 1976, now abandoned.

BACKGROUND AND BRIEF SUMMARY OF THE INVENTION

This invention relates to an endless tow device particularly adapted for towing people over snow and/or ice covered surfaces. Alternatively, it may be used for towing people over any low frictional surface such as ice or water.

In the operation of outdoor recreational areas, particularly winter resorts, elaborate structures are provided for transporting skiers up slopes. The cost of such structures, whether T-bars, chairlifts, or gondolas, are such that they can only be economically used for selected slopes and trails.

There are many instances where tows would be advantageous, such as beginners' slopes and moving upwardly and across from one trail to another. However, it is not economical to install the currently available tows for such limited use.

My invention provides a tow, easily made portable, which is eminently useful for the above-described situations, and which is extremely economical.

In the invention, disclosed in my parent application, an endless knotted tow line was provided which line was made from any suitable material such as manilla, sisal, polypropylene, nylon, etc. The drive for the tow line comprised two inflatable resilient tires, each rotatably secured to a frame. The tires were disposed one above the other, their bearing surfaces in frictional engagement. The cord passed through the contacting surfaces in a direction substantially normal to the axes of rotation of the tires. The tires were inflated such that the knotted portions of the cord passed without being deformed. This also allowed the contacting surface areas to remain substantially uniform. In the preferred embodiment, one of the tires was driven and the other tire was idle. In the practice of the invention disclosed in my parent application it was found in practice that ice and/or snow tended to accumulate on the tow line. This resulted in slippage and faulty operation.

In the present invention resilient tires are again used. However, one of the tires, preferably the drive tire, is substantially rigid in reference to the idle tire it engages. Further the bearing surface of the rigid tire is characterized by a plurality of ridges. The resiliency (softness) of the idle tire is adjusted such that the ridge elastically deforms the idle tire. The tow line passes over the ridges and into the deformation and is clamped therebetween. This results in the tires functioning as gears. The tow line is driven through the tires both by the frictional engagement of the bearing surfaces and by the clamping action.

The tow line preferably is knotted.

Alternatively, both tires may be driven, or the soft tire be driven and the rigid tire be soft.

DESCRIPTION OF THE PREFERRED EMBODIMENT

Figure 1:
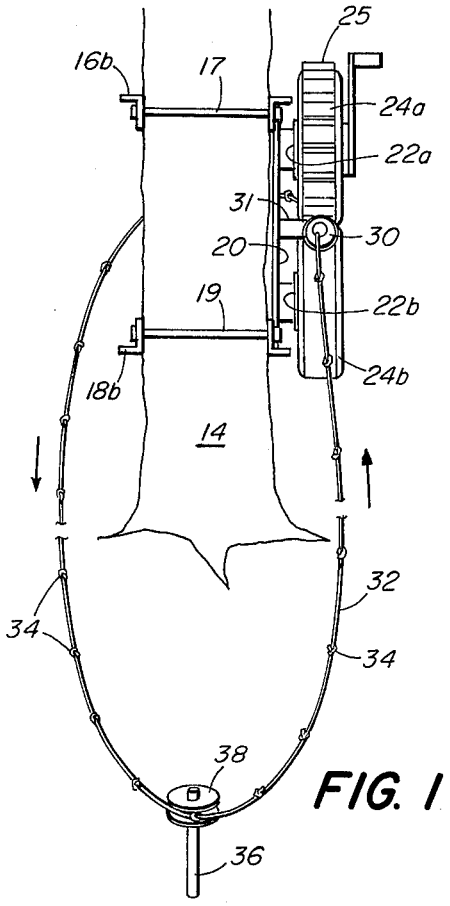
FIG. 1 is a front view of a tow system incorporating the invention.
Figure 2:
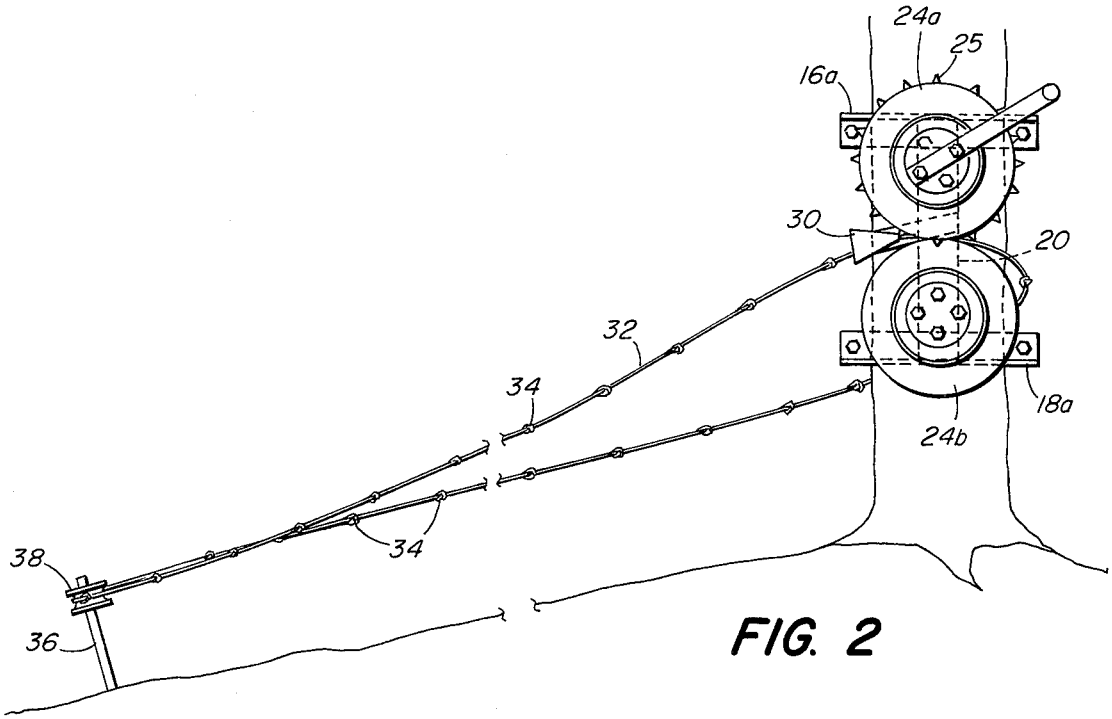
FIG. 2 is a side view of the tow system of FIG. 1.

Referring to FIGS. 1 and 2, a frame assembly is secured to a post or tree 14 or anchored independently. Upper horizontal support members 16*a* and 16*b* are secured on either side of the tree 14 by bolts 15. Lower horizontal support members 18*a* and 18*b* are secured on either side of the tree 14 by bolts 19. A vertical support member 20, shown more clearly in FIG. 2, is secured to the upper and lower members 18*a* and 18*b* such as by welding or bolting.

The vertical support member 20 includes upper and lower lug plates 22*a* and *b*, shown most clearly in FIG. 1, rotatably secured thereto. Secured by bolts to the lug plates 22*a* and *b* are standard inflatable upper and lower pneumatic rubber tires comprising a rigid drive tire 24*a* and a soft idle tire 24*b*. The bearing surface of the rigid tire 24*a* includes a plurality of ridges 25 in equally spaced parallel relationship. The axes of the ridges 25 are transverse to the direction of travel of a tow line 25 passing therethrough. For example, standard tubeless automobile tires mounted on conventional rims may be used. The ridges may be formed by uniformly removing portions (cleats) from a standard tire such as a snow tire. Alternatively a smooth surface tire may have rubber ridges, such as in the form of a prism secured to the tire 24*a*. For example prism-like ridges 25 of a composition similar or identical to the tire 24*a* may be cemented at their bases to the surface of the tire 24*a*. Other methods for forming the ridges will be apparent to those skilled in the art. The opposed threaded or bearing surfaces are in frictional engagement. The ridges 25 are spaced such that a ridge 25 is always engaging the surface of the tire 24*b*. A crank arm 26 is bolted to the portion of the lugs which extend beyond the wheel 26*a*. A hollow cone-like guide 30 is fixedly secured to the member 20 by a guide arm 31.

The tow line 32 having a plurality of generally equally spaced protuberances 34 thereon passes through the guide 30, between the engaged surfaces of the tires 24*a* and 24*b*, around the tree 14 and about a guide post 36 having a rotatable disc 38 with a concave outer surface over which the tow line travels. The protuberances 34 are formed simply by knotting the tow line.

In the operation of the invention, the tow line 32 is formed into an endless loop and travels through the tires 24*a* and *b*, about the tree 14 and around the guide post 36.

The manual crank arm 26 bolted to the upper tire 24 is rotated, drawing the tow line therethrough. If desired, a power-driven mechanical device may be used. Skiers wishing to ascend the slope simply hold onto one of the protuberances and are pulled up the slope. It is important to note that substantially all the tension on the tow line is upstream of the tires. Once the tow line passes through, no structure is required to maintain any tension or take up any slack. The tow line essentially "goes limp." The tree and guide post 36 merely serve to maintain the orientation of the tow line.

Figure 3:
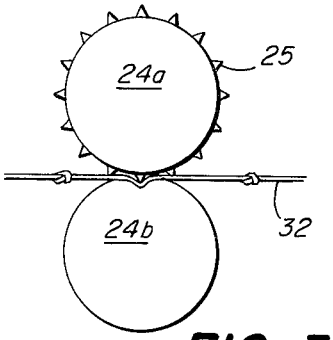
FIG. 3 is a side view illustrating the contact between the tires of the drive for the tow line.

As shown in FIG. 3, because of the controlled resiliency of the tires through inflation, maximum gripping engagement is maintained at all times.

FIG. 3 illustrates the clamping action of the ridge 25 with the attendant elastic deformation of the tire 24*b*. The knots 34 are spaced in the tow line 32 to space properly the users of the tow device. Whether or not the ridge engages a knot is immaterial. The contact between the bearing surfaces is substantially the same at all times. Stated otherwise, if the engaged surface area as shown in between 6–12 square inches, this surface area will not diminish more than 10% when a protuberance on the tow line passes through. In addition to maintaining the substantially constant surface area, the resiliency of the engaged surfaces prevents or inhibits the deformation and/or destruction of the protuberances.

Having described my invention, what I now claim is:

1. A tow device which comprises:

(a) a substantially rigid roller having a bearing surface with a plurality of elongated ridges formed on the bearing surface and extending therefrom;

(b) a substantially soft roller having a bearing surface in contacting engagement with the bearing surface of the rigid roller, the rollers providing the entire driving force for a towline passing therebetween, at least one ridge at all times frictionally engaged with and elastically deforming the soft roller the longitudinal axes of the ridges transverse to the direction of the towline passing between the bearing surfaces, the towline clamped therebetween;

(c) means to rotate at least one of the rollers to draw the towline therethrough;

(d) the towline being endless and having a plurality of equally spaced protuberances formed integrally therewith, first guide means adjacent and upstream of the rollers, the towline and the protuberances received between the bearing surfaces in a direction substantially perpendicular to the axes of rotation of the rollers;

(e) means to vary the resiliency of the rollers to maintain the amount of frictional engagement between the surfaces substantially the same at all times and to allow the protuberances to pass between the bearing surfaces without deformation; and, (f) second guide means to maintain solely the orientation of the towline downstream of the rollers said second guide means positioned such that there is substantially no tension on the towline downstream of the rollers and upstream of the second guide means, the towline discharged from the rollers in a direction non-perpendicular to the axes of rotation of the rollers.

2. The tow device of claim 1 wherein the ridges are prism shaped in transverse cross-section.

* * * * *